US007407241B2

(12) United States Patent
Mutoh et al.

(10) Patent No.: US 7,407,241 B2
(45) Date of Patent: Aug. 5, 2008

(54) INK-JET HEAD DEVICE, INK-JET DEVICE, AND INK-SUPPLYING METHOD OF INK-JET HEAD DEVICE

(75) Inventors: Yoshinori Mutoh, Yamatokoriyama (JP); Kaoru Higuchi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 410 days.

(21) Appl. No.: 11/169,055

(22) Filed: Jun. 27, 2005

(65) Prior Publication Data

US 2006/0044369 A1 Mar. 2, 2006

(30) Foreign Application Priority Data

Aug. 30, 2004 (JP) ..... 2004-251059

(51) Int. Cl.
*B41J 29/38* (2006.01)
*B41J 2/175* (2006.01)

(52) U.S. Cl. ..... 347/5; 347/85

(58) Field of Classification Search ..... 347/5, 347/7, 84, 85; 141/2, 18
See application file for complete search history.

(56) References Cited

U.S. PATENT DOCUMENTS 4,714,937 A 12/1987 Kaplinsky
5,997,121 A * 12/1999 Altfather et al. ..... 347/7
6,079,808 A * 6/2000 Yamaguchi ..... 347/30
6,234,615 B1 * 5/2001 Tsukuda ..... 347/85
6,315,402 B1 11/2001 Kawase
6,402,306 B1 6/2002 Childers et al.
6,520,630 B1 2/2003 Oda et al.
6,866,355 B2 * 3/2005 Aruga et al. ..... 347/7
6,866,372 B2 * 3/2005 Oda et al. ..... 347/85
6,877,846 B2 * 4/2005 Fellingham et al. ..... 347/85
7,252,361 B2 * 8/2007 Nishikawa et al. ..... 347/22
2001/0009432 A1 7/2001 Olsen et al.
2002/0008744 A1 1/2002 Ortis, Jr. et al.
2002/0021340 A1 2/2002 Olsen et al.

FOREIGN PATENT DOCUMENTS

JP 63-172654 7/1988
JP 2000-141687 5/2000
JP 2001-130024 5/2001
JP 2001-187459 7/2001
JP 2003-266734 9/2003

* cited by examiner

*Primary Examiner*—Anh T. N. Vo
(74) *Attorney, Agent, or Firm*—David G. Conlin; David A. Tucker; Edwards Angell Palmer & Dodge LLP

(57) ABSTRACT

In an ink-jet head device, a main tank, a sub tank and an ink-jet head are mounted in this order in a carriage, with the main tank placed at the top. The main tank, sub tank and ink-jet head are connected to one another by a three-way ink conduit. At a junction of the ink conduit is disposed a three-way switching valve, which selectively switch a path connecting the sub tank to the main tank and a path connecting the sub tank to the ink-jet head, without causing the ink-jet head and the main tank to communicate with each other. As a result, an ink-jet head device and an ink-supplying method are realized, in which the ink-jet head can maintain suitable negative pressure and in which consumption of ink is reduced.

9 Claims, 3 Drawing Sheets

INK-JET HEAD DEVICE, INK-JET DEVICE, AND INK-SUPPLYING METHOD OF INK-JET HEAD DEVICE

This Nonprovisional application claims priority under 35 U.S.C. § 119(a) on Patent Application No. 251059/2004 filed in Japan on Aug. 30, 2004, the entire contents of which are hereby incorporated by reference.

FIELD OF THE INVENTION

The present invention relates to an ink-jet head device for jetting ink to a medium, an ink-jet device, and an ink-supplying method used in the ink-jet head device. The present invention particularly relates to: an ink-jet head device including an ink tank, an ink-jet head, and a carriage; an ink-jet device using the ink-jet head device; and a method for supplying ink from the ink tank to the ink-jet head in the ink-jet head device. As used herein, the "ink" is not just limited to those used for printing or drawing on a medium like paper, but the term refers to fluids in general.

BACKGROUND OF THE INVENTION

Today, examples of devices using the ink-jet technology include ink-jet printers that jet ink on a medium like recording paper to perform drawing (as used herein "drawing" includes "printing"), and industrial devices that form circuits on substrates. The ink-jet devices include an ink tank for reserving ink, an ink-jet head for adjusting and jetting ink, and a carriage for moving the ink-jet head.

In common conventional ink-jet devices, the ink tank is located above the ink-jet head in the carriage. In these devices, ink is supplied due to the head difference between the ink tank and the ink-jet head.

In devices such as large ink-jet printers or large production devices using the ink-jet technology, the amount of consumed ink is inevitably increased, and accordingly large-capacity ink tanks are used. In this case, the head difference between the ink tank and the ink-jet head varies widely according to how much ink is left, and it sometimes causes troubles.

For example, if the amount of remaining ink is large, the head difference between the ink tank and the ink-jet head becomes large, and accordingly applied pressure on the ink-jet head becomes large. As a consequence, it becomes impossible to maintain enough negative pressure not to leak ink in the ink-jet head, with the result that ink may leak out of the ink-jet head. On the contrary, if the amount of remaining ink is small, the head difference between the ink tank and the ink-jet head becomes small, and accordingly negative pressure in the ink-jet head becomes large. As a consequence, the ink-jet head sucks air, with the result that ink cannot be jetted.

In order to solve these problems, there has been known an ink-jet device in which, instead of providing an ink tank in a carriage, the ink tank is provided in a housing of the main body and below the ink-jet head so that the head difference is eliminated. In this kind of ink-jet device, ink is supplied through a flexible conduit connecting the ink tank in the housing of the main body to the ink-jet head in the carriage.

Further, there has also been known an ink-jet device in which the ink tank is divided into a large-capacity main tank and a small-capacity sub tank, and the main tank is disposed in a housing of the main body and the sub tank is disposed in a carriage. In this kind of ink-jet device, the main tank is connected with the sub tank by a flexible conduit. Normally, ink is supplied from the sub tank to an ink-jet head, and, when the amount of remaining ink in the sub tank becomes small, the sub tank is refilled with ink from the main tank. Here, in order to refill the sub tank with ink from the main tank, pressurizing means in the main tank, or negative pressure generating means in the sub tank is used. With the above structure, because the sub tank in the carriage has a small capacity and the head difference between the sub tank and the ink-jet head is small, the problem of ink leakage or jet failure can be solved.

Japanese Laid-Open Patent Publication No. 266734/2003 (Tokukai 2003-266734; published on Sep. 24, 2003) describes such ink-jet recording device having a main tank in a housing of the main body, and a sub tank in a carriage. This ink-jet recording device includes negative pressure and back pressure generating means in the sub tank, and thereby generates suitable negative pressure and back pressure in the sub tank. In this way, the problem of ink leakage or jet failure is solved.

However, the above conventional structure in which the ink tank is located in the housing of the main body, and in which ink is supplied through a flexible conduit to the ink-jet head provided in the carriage poses the following problems.

In the ink-jet recording device having the above structure, in order to supply ink from the ink tank in the housing of the main body to the ink-jet head in the carriage, the flexible conduit needs to be filled with ink. In this case, because the flexible conduit leads from the ink tank in the housing of the main body to the ink-jet head in the carriage, the amount of ink needed to fill the flexible conduit is inevitably increased compared with an ink-jet device in which the ink tank is provided in a carriage. Further, in larger devices, because the length of flexible conduits increases, this problem becomes more serious. As the above example shows, in the conventional ink-jet recording device that has the ink tank outside the carriage and supplies ink through the flexible conduit, a problem occurs that more ink is consumed compared to an ink-jet device in which the ink tank is provided in a carriage.

Further, in the ink-jet device with two ink tanks (main tank and sub tank) as reported in the above Japanese Laid-Open Patent Publication No. 266734/2003, the problem of increased ink consumption also occurs because the flexible conduit connecting the main tank and the sub tank needs to be filled with ink.

SUMMARY OF THE INVENTION

The present invention was made in view of foregoing problems, and it is an object of the present invention to realize an ink-jet head device with a main tank and a sub tank, in which the ink-jet head can maintain suitable negative pressure, and in which consumption of ink is reduced, and to realize an ink-jet device including the ink-jet head device, and an ink-supplying method for the ink-jet head device.

In order to solve the above problem, an ink-jet head device according to the present invention includes an ink-jet head for jetting ink; a sub tank for reserving ink to be supplied to the ink-jet head; a main tank for reserving ink to refill the sub tank; a movable carriage, including the ink-jet head; and a negative pressure generating unit, connected to the sub tank, for reducing pressure inside the sub tank relative to the ink-jet head, the main tank, the sub tank, and the ink-jet head being mounted in the carriage.

With the above structure, by the provision of the negative pressure generating unit, the ink-jet head can maintain suitable negative pressure. Further, in this case, because ink-reserving tank is divided into the sub tank and the main tank, the capacity of the sub tank, which varies the negative pressure of the ink-jet head, can be reduced. Accordingly, changes in the negative pressure of the ink-jet head, caused by changes in the volume of the reserved ink, can be reduced and stabilized. Further, a required negative pressure in the negative pressure generating unit can be reduced.

Further, in the above structure, because the main tank and the sub tank are mounted in the carriage together with the ink-jet head, the distance between the ink-jet head, the main tank, and the sub tank is short. This enables the length of a conduit needed to connect the ink-jet head with the sub tank to be reduced. Therefore, the amount of ink that remains in the conduit is reduced, thereby reducing consumption of ink as compared with the case where the main tank is provided outside.

In order to solve the above problem, the ink-jet device of the present invention includes the above ink-jet head device.

With the above structure, an ink-jet device can be realized in which an ink-jet head can maintain suitable negative pressure and in which consumption of ink is reduced.

In order to solve the foregoing problems, an ink-supplying method according to the present invention includes in a carriage an ink-jet head for jetting ink, a sub tank for reserving ink to be supplied to the ink-jet head, and a main tank for reserving ink to refill the sub tank, the sub tank being an elastic and bag-shaped ink reservoir, and the ink-jet head being controlled to have negative pressure to prevent ink leakage, and the method comprising the step of flowing the ink in the sub tank back to the main tank by making pressure inside the sub tank relatively higher than pressure inside the main tank, the step being carried out after the sub tank is refilled with ink from the main tank and before the sub tank and the ink-jet head communicate with each other.

In the course of refilling the sub tank with ink from the main tank, the sub tank, being elastic, expands due to the head difference, with the result that pressure is applied inside the sub tank. In other words, in the sub tank, the ink contained in the extra space created by the expansion will be an excess. With the above structure, however, the excess ink is ejected from the sub tank by making pressure inside the sub tank relatively higher than pressure inside the main tank. As a result, when the sub tank is in communication with the main tank, the extra pressure on the ink-jet head is not created by the expansion of the sub tank. Therefore, the ink-jet head can maintain suitable negative pressure.

Further, with the above structure, the excess ink ejected from the sub tank can be flown back to the main tank. This enables consumption of ink to be reduced.

For a fuller understanding of the nature and advantages of the invention, reference should be made to the ensuing detailed description taken in conjunction with the accompanying drawings.

DESCRIPTION OF THE EMBODIMENTS

Embodiments of the present invention will be described below with reference to FIG. 1 through FIG. 4. Note that the present invention is not limited to these embodiments.

Figure 1:
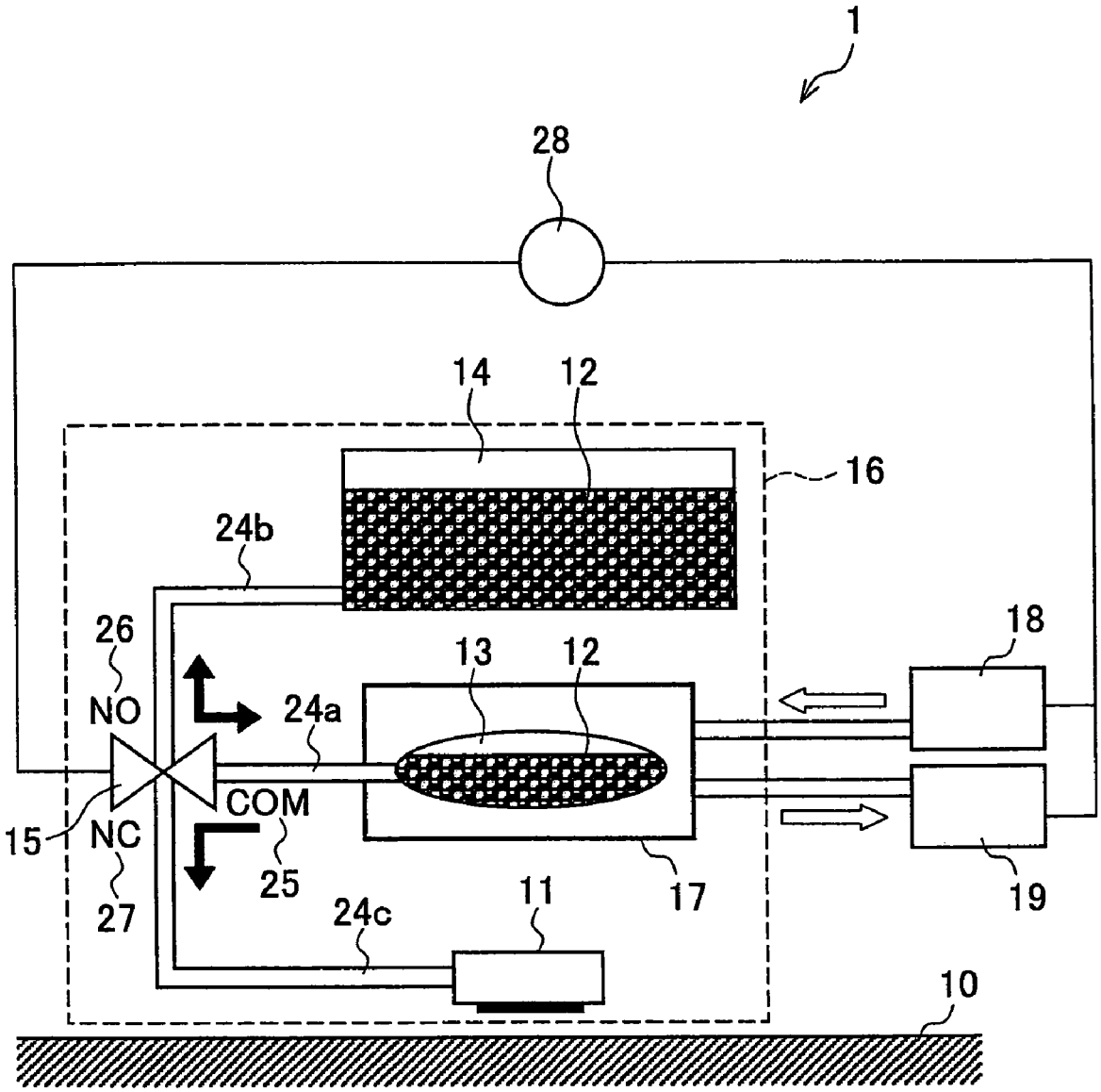
FIG. 1 is a schematic diagram showing a main structure of an ink-jet head device according to one embodiment of the present invention.

FIG. 1 relates to one embodiment of the present invention, schematically showing a main structure of an ink-jet head device 1 mounted in an ink-jet device. As shown in FIG. 1, main components of the ink-jet head device 1 of the present embodiment include an ink-jet head 11, a sub tank 13, a main tank 14, a three-way switching valve (flow path switching means; flow path switching unit) 15, ink conduits (three-way flow path) 24*a*, 24*b*, 24*c*, a movable carriage 16, relative positive pressure generating means (relative positive pressure generating unit) 18, negative pressure generating means (negative pressure generating unit) 19, and a controller (flow path controller, relative positive pressure controller, negative pressure controller) 28.

Here, the ink-jet head 11, the sub tank 13 and the main tank 14 are mounted in the carriage 16. In the carriage 16, the sub tank 13 is located above the ink-jet head 11, and the main tank 14 is located above the sub tank 13.

The ink-jet head 11 faces a recording medium 10, and scans along a recording face of the recording medium 10 with movement of the carriage 16. While scanning, the ink-jet head 11 jets ink 12 onto the recording medium 10 with an adjusted amount of ink 12.

The sub tank 13 reserves the ink 12 that is to be supplied to the ink-jet head 11. The sub tank 13 is stored in a tank box 17. The tank box 17 is highly airtight and does not undergo expansion or contraction. Note that it is preferable that the sub tank 13 be elastic and have a bag-like shape.

The tank box 17 is connected with the relative positive pressure generating means 18 and the negative pressure generating means 19 through respective flexible conduits, the relative positive pressure generating means 18 and the negative pressure generating means 19 being located outside the carriage.

The relative positive pressure generating means 18 is for increasing the pressure inside the tank box 17 through the flexible conduit, so as to create positive pressure inside the sub tank 13 relative to the pressure inside the main tank 14.

The negative pressure generating means 19 is for reducing the pressure inside the tank box 17 through the flexible conduit, so as to create negative pressure inside the sub tank 13 relative to the ink-jet head 11. Note that the relative positive pressure generating means 18 and the negative pressure generating means 19 do not function simultaneously.

The main tank 14 reserves the ink 12 for refilling the sub tank 13. Note that in the ink-jet head device 1 of the present embodiment, the capacity of the sub tank 13 is smaller than that of the main tank 14.

The three-way switching valve 15 has an electromagnetic valve, and includes a common port (COM) 25, a normally open port (NO) 26, and a normally closed port (NC) 27. The NO 26 and NC 27 are non-common ports.

The three-way switching valve 15 can switch flow paths with the electromagnetic valve, according to whether voltage is applied or not. Normally, that is, under no applied voltage, the COM 25 is in communication with the NO 26. Applying a predetermined voltage (for example, 24 V) operates the electromagnetic valve, connecting the COM 25 to the NC 27 and disconnecting the COM 25 from the NO 26.

The ink-jet head 11 is connected with the NC 27 of the three-way switching valve 15 by the ink conduit 24*c*, the sub tank 13 is connected with the COM 25 of the three-way switching valve 15 by the ink conduit 24*a*, and the main tank 14 is connected with the NO 26 of the three-way switching valve 15 by the ink conduit 24*b*.

Here, the COM 25 is always in communication with either the NO 26 or the NC 27, and the NO 26 and the NC 27 are never in communication with each other. That is, the ink-jet head 11 and the main tank 14 are never in communication with each other. As a result, there will be no pressure difference between the main tank 14 and the ink-jet head 11 due to a head difference, allowing the ink-jet head 11 to stably maintain negative pressure. With the above structure, leak of ink from the ink-jet head, caused by a head difference between the ink-jet head 11 and the large-capacity main tank 14, can be avoided.

Note that the three-way switching valve 15 assumes use of chemicals, and therefore it is preferable that portions in contact with liquid and the ink conduits 24*a*, 24*b*, 24*c* are made of Teflon™ resin. Further, it is desirable that the ink conduits 24*a*, 24*b*, 24*c* be made of a Teflon™ tube and/or a Kalrez tube.

The controller 28 serves as a flow path controller for controlling the three-way switching valve 15, a relative positive pressure controller for controlling the relative positive pressure generating means 18, and a negative pressure controller for controlling the negative pressure generating means 19. Note that, the flow path controller, the relative positive pressure controller, and the negative pressure controller may be separately provided.

The controller 28, serving as the flow path controller, applies voltage to the three-way switching valve 15, so as to control switching of flow paths in the three-way switching valve. In supplying ink from the sub tank 13 to the ink-jet head 11, the controller 28 applies voltage to the three-way switching valve 15 so as to connect the COM 25 to the NC 27 and thereby connect the sub tank 13 to the ink-jet head 11. In refilling the sub tank 13 with the ink from the main tank 14, the controller 28 does not apply voltage to the three-way switching valve 15, so as to connect the COM 25 to the NO 26 and thereby connect the sub tank 13 to the main tank 14.

Further, the controller 28, serving as the relative positive pressure controller, controls the relative positive pressure generating means 18, so that the relative positive pressure generating means 18 applies a predetermined pressure at a predetermined timing for a predetermined time period. More details will be described later.

Further, the controller 28, serving as the negative pressure controller, controls the negative pressure generating means 19, so that the negative pressure generating means 19 applies a predetermined pressure at a predetermined timing for a predetermined time period. More details will be described later.

Next, movement of the ink-jet head device 1 will be explained.

First, description is made as to how the ink-jet head device 1 performs drawing.

Prior to carrying out drawing in the ink-jet head device 1, the controller 28 applies a predetermined voltage to the three-way switching valve 15. As a result, the COM 25 communicates with the NC 27. Namely, the sub tank 13 communicates with the ink-jet head 11. Because the sub tank 13 is located above the ink-jet head 11, the ink 12 is supplied from the sub tank 13 to the ink-jet head 11 by the pressure due to a head difference.

Further, in the above condition, namely, in the condition that the sub tank 13 and the ink-jet head 11 are in communication with each other, there is a possibility that the head difference between the ink-jet head 11 and the sub tank 13 may cause the ink 12 to leak out of the ink-jet head 11. In order to prevent it, the controller 28 controls the negative pressure generating means 19 to generate negative pressure inside the tank box 17. More details are as follows.

In the ink-jet head device 1 of the present embodiment, the head difference between the ink-jet head 11 and the sub tank 13 is 10 cm. The head difference of 10 cm generates a pressure of 1 kPa. Thus, if the pressure exerted on the sub tank 13, namely, the pressure inside the tank box 17 is the same as atmospheric pressure, and if the carriage 16 is stationary, then the ink-jet head 11 experiences an additional 1 kPa relative to atmospheric pressure. Namely, the pressure exerted on the ink-jet head 11 exceeds the external pressure by 1 kPa. The additional 1 kPa causes ink leakage. Further, while the carriage 16 is moving, the positive pressure on the ink-jet head 11 may become even greater by the deceleration and acceleration of the carriage 16.

Therefore, in the ink-jet head device 1 of the present embodiment, the negative pressure generating means 19 generates negative pressure inside the sub tank 13, and thereby cancels out the positive pressure caused by the head difference and/or the acceleration and deceleration of the carriage 16. To put it concretely, the negative pressure generating means 19 reduces pressure inside the highly airtight tank box 17 by suctioning. The amount of reduced pressure is determined by taking into consideration the pressure caused by the head difference between the sub tank 13 and the ink-jet head 11, and the pressure caused by the acceleration and deceleration of the carriage 16. Namely, the amount of reduced pressure is set to be greater than the sum of the pressure caused by the head difference between the sub tank 13 and the ink-jet head 11, and the maximum positive pressure caused by the acceleration and deceleration of the carriage 16. In the ink-jet head device 1 of the present embodiment, the pressure generated by the head difference is 1 kPa, and therefore the amount of reduced pressure is 2 kPa with a margin of additional 1 kPa, which may be generated by the pressure change caused by the movement of the carriage 16.

As described above, in the ink-jet head device 1 of the present embodiment, with the sub tank 13 in communication with the ink-jet head 11, the controller 28 controls the negative pressure generating means 19 so that the pressure inside the tank box 17 is reduced by 2 kPa. As a result, the ink-jet head 1 1 can overcome the pressure change caused by the head difference between the ink-jet head 11 and the sub tank 13, and/or the pressure change caused by the acceleration and deceleration of the carriage 16, thereby stably maintaining negative pressure.

Further, because the sub tank 13 has a small capacity, the head difference does not vary greatly when the remaining amount of the ink 12 is large and when it is small. Accordingly, there will be no large difference in pressure caused by the head difference. Therefore, even though the negative pressure generating means 19 reduces pressure at a fixed rate, there will be no excess negative pressure inside the ink-jet head 11 when the remaining amount of the ink 12 becomes small. Thus, even when the remaining amount of ink is small, the problem of the ink-jet head 11 sucking air and not jetting ink does not occur.

Next, description is made as to how the sub tank 13 is refilled with the ink 12 from the main tank 14. Note that refilling of the ink 12 is carried out when the amount of the ink 12 becomes smaller than a predetermined amount, for example, after a large number of drawing operations performed by the ink-jet head device 1, or after maintenance. Refilling of the ink 12 is also carried out when the power is off.

When the amount of the ink 12 in the sub tank 13 falls below a predetermined amount, or when the power of the ink-jet head device 1 is turned off, the voltage supply to the three-way switching valve 15 stops. With no applied voltage to the three-way switching valve 15, the COM 25 communicates with the NO 26. Namely, the sub tank 13 is in communication with the main tank 14. Because the main tank 14 is located above the sub tank 13, the sub tank 13 is refilled with the ink 12 as the ink 12 is supplied from the main tank 14 due to the head difference. Note that while the ink is refilled, the controller 28 controls the negative pressure generating means 19 so that no negative pressure is created.

In the ink-jet head device 1 of the present embodiment, the head difference between the sub tank 13 and the main tank 14 ranges from 20 cm to 30 cm, and the pressure generated by the head difference ranges from 2 kPa to 3 kPa. The capacity of the sub tank 13 is 20 cc. It has been confirmed that it takes about 40 seconds for the pressure generated by the head difference to fully refill the sub tank 13 from an empty state.

Here, assume that voltage is applied to the three-way switching valve 15 without accompanying any other operations after refilling the ink 12, and the ink-jet head 11 communicates with the sub tank 13 as a result. In this case, the following problem will occur.

Because refilling of the ink is carried out through the head difference between the sub tank 13 and the main tank 14, the sub tank 13, being elastic, expands in the course of refilling the ink over an extended time period, and thereby applies pressure inside the tank at the same pressure as the one generated by the head difference. Here, if the COM 25 communicates with the NC 27 by the applied voltage to the three-way switching valve 15, the pressure due to the expansion of the sub tank 13 creates a positive pressure in the ink-jet head 11 relative to outside, even if the negative pressure generating means 19 generates a negative pressure of 2 kPa. This causes the problem of leaking of the ink 12 from the ink-jet head 11.

In order to solve the problem, in the ink-jet head device 1 of the present embodiment, the step of ink backflow operation is carried out after the ink is refilled and before the COM 25 communicates with the NC 27. Note that if refilling of the ink 12 is carried out while the power is turned off, the ink backflow operation is carried out immediately after the power is turned on.

Figure 4:
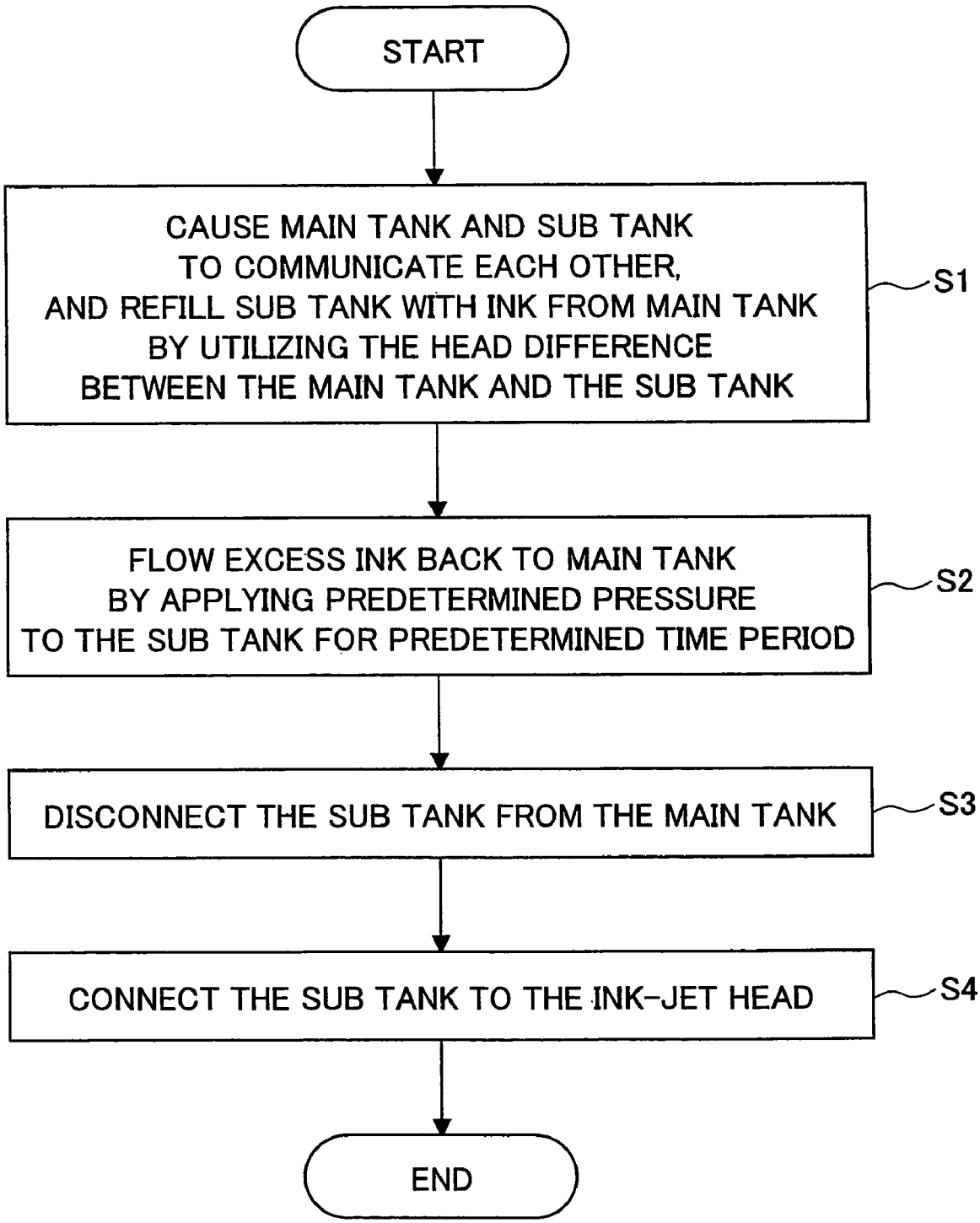
FIG. 4 is a flowchart showing an ink-supplying method of an ink-jet head device according to one embodiment of the present invention.

As shown by the flowchart of FIG. 4, first, the main tank communicates with the sub tank, and the ink is refilled from the main tank to the sub tank by the head difference (step S1). In the present embodiment, this step is carried out by the controller 28 stopping voltage supply to the flow path switching means 15.

Next, a predetermined pressure is applied inside the tank box 17 for a predetermined time period, so as to return an excess amount of ink in the sub tank 13 to the main tank 14 (step S2). In the present embodiment, this step is carried out by the controller 28 controlling the relative positive pressure generating means 18 to apply pressure inside the tank box 17. At this time, the sub tank 13 is in communication with the main tank 14, but the sub tank 13 is not in communication with the ink-jet head 11. As a result, the ink in the pressurized sub tank flows back to the main tank 14, instead of being ejected from the ink-jet head 11. Therefore, consumption of ink can be reduced.

The pressure applied here is to be greater than the one generated by the head difference between the sub tank 13 and the main tank 14. The duration of applied pressure is determined based on the capacity of the sub tank, its elasticity, and the head difference between the sub tank and the main tank. In the present embodiment, the pressurization is carried out by the positive pressure generating means 18 applying a pressure of 10 kPa inside the tank box 17 for 5 seconds. Carrying out the ink backflow operation under the above conditions enables an excess amount of the ink 12 to be flown back to the main tank 14.

Next, communication between the sub tank 13 and the main tank 14 gets shut off (step S3), and communication between the sub tank 13 and the ink-jet head 11 gets opened (step S4). In the present embodiment, step S3 and step S4 are carried out simultaneously. Specifically, as the controller 28 applies voltage to the three-way switching valve 15, the three-way switching valve 15 shuts off communication between the COM 25 and the NO 26, and opens communication between the COM 25 and the NC 27.

Steps S2 through S4 correspond to the ink backflow operation.

At the end of step S4, all the excess ink 12 has been flown back to the main tank 14. Therefore, in the ink-jet head device of the present invention, leak of ink from the ink-jet head 11 can be avoided.

Thereafter, the controller 28 controls the negative pressure generating means 19 to reduce pressure inside the tank box 17, and thereby creates negative pressure in the sub tank 13 relative to the ink-jet head 11. Under this condition, drawing or other operations are carried out.

Next, the negative pressure generating means 19 for generating negative pressure in the sub tank 13 will be explained.

Figure 2:
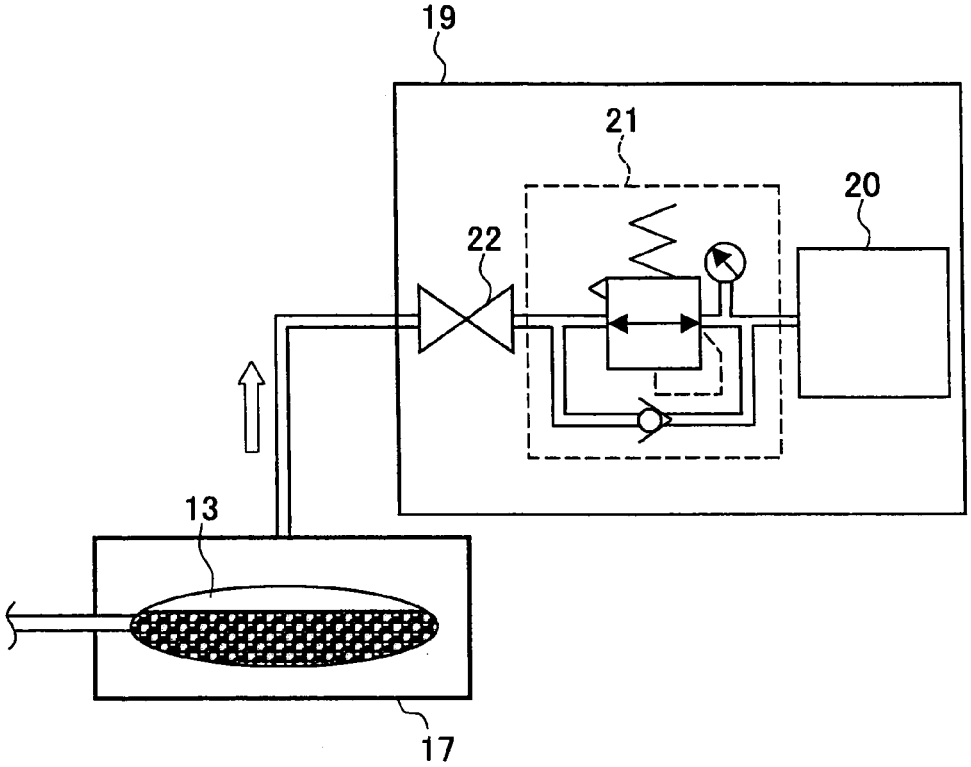
FIG. 2 is a schematic diagram showing a main structure of negative pressure generating means mounted in the ink-jet head device.

FIG. 2 relates to one embodiment of the present invention, schematically showing a main structure of the negative pressure generating means 19. As shown in. FIG. 2, the negative pressure generating means 19 of the present embodiment includes a vacuum pump 20, a regulator 21, and a switching valve 22, and is connected with the sub tank 13. The switching valve 22, the regulator 21 and the vacuum pump 20 are piped in series in this order, with the switching valve 22 closest to the sub tank 13.

In the present embodiment, the negative pressure generating means 19 generates negative pressure by using the vacuum pump 20. The negative pressure generated by the vacuum pump 20 is adjusted to a suitable pressure by the regulator 21. The switching valve 22 is an electromagnetic valve for opening and closing the flow path, and controls whether the pressure inside the sub tank 13 should be reduced with the negative pressure suitably adjusted by the regulator 21. The switching valve 22 closes the flow path under no applied voltage, and opens the flow path under applied voltage. Therefore, the negative pressure generating means 19 is constructed so that it does not reduce pressure when no voltage is applied to the switching valve 22, and reduces pressure when voltage is applied to the switching valve 22.

Note that in the negative pressure generating means 19 of the present embodiment, the position of the regulator 21 and that of the switching valve 22 may be switched. Namely, the regulator 21, the switching valve 22 and the vacuum pump 20 may be piped in series in this order, with regulator 21 closest to the sub tank 13.

Further, the negative pressure generating means 19 may also be constructed as follows.

Figure 3:
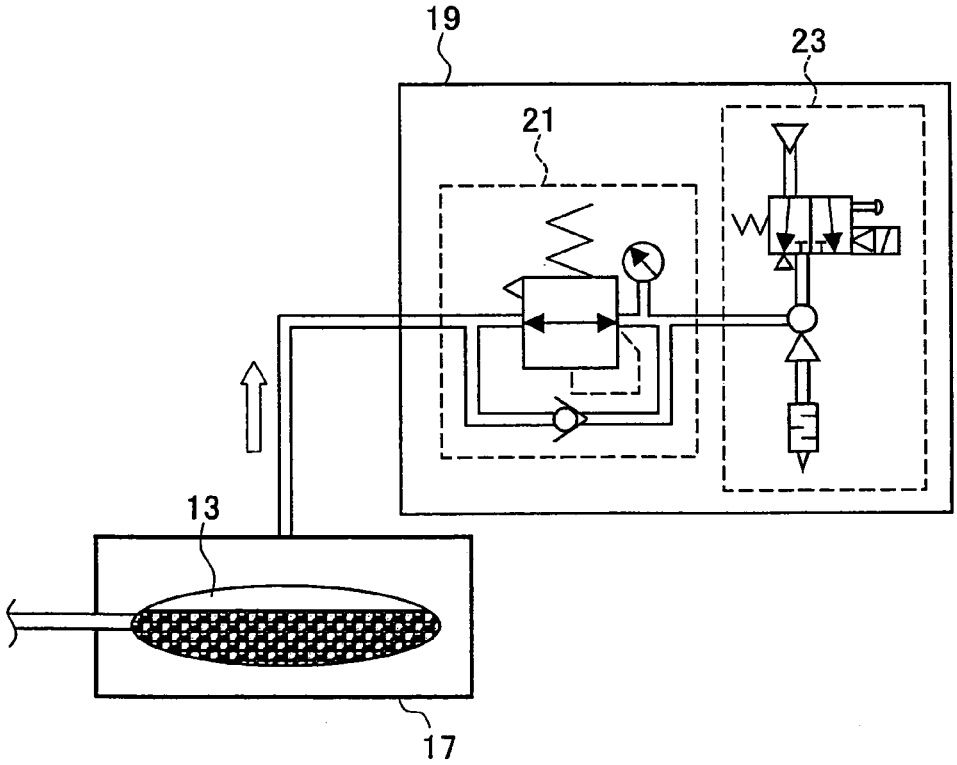
FIG. 3 is a schematic diagram showing a main structure of another negative pressure generating means mounted in the ink-jet head device.

FIG. 3 relates to another embodiment of the present invention, schematically showing a main structure of the negative pressure generating means 19. As shown in FIG. 3, the negative pressure generating means 19 of the present embodiment includes a regulator 21 and a vacuum generator 23, and is connected with the sub tank 13. The regulator 21 and the vacuum generator 23 are piped in series in this order, with the regulator closer to the sub tank 13.

The vacuum generator 23 generates negative pressure upon receiving compressed air. The negative pressure generated by the vacuum generator 23 is adjusted to a suitable pressure by the regulator 21. With the pressure suitably adjusted by the regulator 21, pressure inside the tank box 17 is reduced. Note that the vacuum generator 23 includes an electro-magnetic valve (not shown) for opening and closing the flow path, and controls whether the negative pressure should be supplied to the regulator 21. The electromagnetic valve provided in the vacuum generator 23 closes the flow path under no applied voltage, and opens the flow path under applied voltage. Therefore, the negative pressure generating means 19 is constructed so that it does not reduce pressure when no voltage is applied, and reduces pressure when voltage is applied.

Note that the negative pressure generating means 19 of the present embodiment may also be constructed so that the electromagnetic valve provided in the vacuum generator 23 is not functional. Namely, the negative pressure generating means 19 may include an additional switching valve, with the electromagnetic valve being open at all times. In this case, the additional switching valve is deposed between the regulator 21 and the sub tank 13, or between the regulator 21 and the vacuum generator 23.

The relative positive pressure generating means 18 is not particularly limited. For example, a conventional compressor may be used instead of the vacuum pump 20 or the vacuum generator 23 used in the negative pressure generating means 19. Further, in the present embodiment, the relative positive pressure generating means 18 is constructed to apply pressure to the sub tank 13. However, the relative positive pressure generating means 18 may be connected with the main tank 14 and reduce pressure inside the main tank 14. In the latter case, the relative positive pressure generating means 18 includes the same members as those in the negative pressure generating means, and is connected with the main tank 14.

As shown above, in order to solve the above problem, an ink-jet head device according to the present invention includes: an ink-jet head device including an ink-jet head for jetting ink; a sub tank for reserving ink to be supplied to the ink-jet head; a main tank for reserving ink to refill the sub tank; a movable carriage, including the ink-jet head; and negative pressure generating means (a negative pressure generating unit), connected to the sub tank, for generating negative pressure inside the sub tank relative to the ink-jet head, the main tank, the sub tank, and the ink-jet head being mounted in the carriage.

With the above structure, by the provision of the negative pressure generating means, the ink-jet head can maintain suitable negative pressure. Further, in this case, because ink-reserving tank is divided into the sub tank and the main tank, the capacity of the sub tank, which varies the negative pressure of the ink-jet head, can be reduced. Accordingly, changes in the negative pressure of the ink-jet head, caused by changes in the volume of the reserved ink, can be reduced and stabilized. Further, a required negative pressure in the negative pressure generating means can be reduced.

Further, in the above structure, because the main tank and the sub tank are mounted in the carriage together with the ink-jet head, the distance between the ink-jet head, the main tank, and the sub tank is short. This enables the length of a conduit needed to connect the ink-jet head with the sub tank to be reduced. Therefore, the amount of ink that remains in the conduit is reduced, thereby reducing consumption of ink as compared with the case where the main tank is provided outside.

In the ink-jet head device according to the present invention, it is preferable that the sub tank has a smaller capacity than the main tank.

Since the ink-reserving tank is divided into the sub tank and the main tank such that the main tank has a larger capacity than the sub tank, a large amount of ink can be supplied to the ink-jet head while at the same time maintaining stable negative pressure in the ink-jet head.

The ink-jet head device according to the present invention may be adapted to include: a three-way flow path that connects the sub tank, the main tank, and the ink-jet head to one another, such that the sub tank is located above the ink-jet head and the main tank is located above the sub tank; a flow path switching unit, disposed at a junction of the three-way flow path, for selectively switching a flow path connecting the sub tank to the main tank and a flow path connecting the sub tank to the ink-jet head, without causing the ink-jet head and the main tank to communicate with each other; and a flow path controller for controlling the flow path switching unit.

With the above structure, the sub tank, the ink-jet head and the main tank are connected with the flow path switching means. This enables ink to be supplied when the sub tank is in communication with the ink-jet head, and to be refilled when the sub tank is in communication with the main tank. Here, the ink can be supplied from the sub tank to the ink-jet head by utilizing the head difference between the ink-jet head and the sub tank. Further, the ink can be refilled from the main tank to the sub tank by utilizing the head difference between the sub tank and the main tank. Therefore, a driving device to supply and/or refill ink is not necessary, and a structure of the ink-jet device can be simplified and reduced.

Further, because the ink-jet head and the main tank are not in communication with each other, the head difference between the ink-jet head and the main tank reserving a large volume of ink does not generate pressure when supplying or refilling ink. Therefore, the ink-jet head can always maintain suitable negative pressure.

The ink-jet head device according to the present invention may be adapted so that the flow path switching means include a common port that always provides a flow path, and two non-common ports that are selectively switched to provide a flow path to the common port, the common port is connected with the sub tank, one of the two non-common ports is connected with the main tank, and the other of the two is connected with the ink-jet head.

With the above structure, because the common port is in communication with only one of the two non-common ports at a given time, the sub tank connected with the common port is disconnected from the flow path that leads to the one of the ink-jet head or the main tank, while the sub tank is in communication with the flow path leading to the other. Therefore, the control for switching the flow paths needs not be carried out for each flow path, allowing for simple control. Therefore, the ink-jet head device can be made simple and small.

The ink-jet head device of the present invention may be adapted so that it further includes: relative positive pressure generating means (a relative positive pressure generating unit) for making pressure inside the sub tank relatively higher than pressure inside the main tank; and a relative positive pressure controller for controlling the relative positive pressure generating means, wherein the relative positive pressure controller drives the relative positive pressure generating means for a predetermined time period in response to the flow path controller controlling the flow path switching unit to refill the sub tank with ink from the main tank, and wherein the sub tank is an elastic and bag-shaped ink reservoir.

With the above structure, because the flow path switching means communicates with the sub tank to the main tank under no applied voltage, the sub tank can be automatically refilled with ink from the main tank while the power of the ink-jet head device is turned off, namely, while the ink-jet head device is not in use.

It is preferable that the ink-jet head device of the present invention further includes: relative positive pressure generating means (a relative positive pressure generating unit) for making pressure inside the sub tank relatively higher than pressure inside the main tank; and a relative positive pressure controller for controlling the relative positive pressure generating means, wherein the relative positive pressure controller drives the relative positive pressure generating means for a predetermined time period in response to the flow path controller controlling the flow path switching unit to refill the sub tank with ink from the main tank, and wherein the sub tank includes an elastic and bag-shaped ink reservoir.

In the course of refilling the sub tank with ink from the main tank, the ink-reserving section of the sub tank experiences the force of contraction due to its elastic property. As a consequence, the pressure inside the sub tank becomes greater than a preset pressure. If the inner pressure exceeds the negative pressure applied to an ink-jet head by negative pressure generating means, the pressure applied on the ink-jet head becomes positive, which may cause ink leakage.

In the above structure, when the sub tank is refilled with ink from the main tank, the relative positive pressure controller drives the relative positive pressure generating means for a predetermined time period so as to make pressure inside the sub tank higher than pressure inside the main tank. As a result, the sub tank ejects some of the ink to the main tank. Therefore, when the sub tank is in communication with the ink-jet head, the contraction of the ink-reserving section does not apply excessive positive pressure on the ink-jet head, with the result that the ink-jet head can maintain suitable negative pressure.

Further, with the above structure, because the ink flown back to the main tank, wasteful consumption of ink can be suppressed and ink can be saved.

The ink-jet head device of the present invention may be adapted so that the relative positive pressure generating means make pressure inside the sub tank relatively higher than pressure inside the main tank by applying pressure to the sub tank.

With this structure, pressure inside the sub tank can easily be made higher than pressure inside the main tank, and the ink can be flown back to the main tank from the sub tank.

The ink-jet head device of the present invention may be adapted so that the negative pressure generating means include a vacuum pump for generating negative pressure; a regulator, disposed between the sub tank and the vacuum pump, for controlling negative pressure generated by the vacuum pump; and a switching valve, disposed between the sub tank and the vacuum pump, for opening and closing a flow path.

With the above structure, negative pressure generated by the vacuum pump can be adjusted to a desired pressure by the regulator. As a result, a suitable negative pressure can be generated in the sub tank. Further, the switching valve can switch between a state that negative pressure is generated in the sub tank and a state that negative pressure is not generated in the sub tank. Therefore, the ink-jet head can maintain suitable negative pressure.

The ink-jet head device of the present invention may be adapted so that the negative pressure generating means include a vacuum generator; a regulator, disposed between the sub tank and the vacuum generator, for controlling negative pressure generated by the vacuum generator; and a switching valve, disposed between the sub tank and the vacuum generator, for opening and closing a flow path.

With the above structure, the negative pressure generated by the vacuum generator can be adjusted to a desirable pressure by the regulator. As a result, a suitable negative pressure can be generated in the sub tank. Further, the switching valve provided to the vacuum generator can switch between a state that negative pressure is generated in the sub tank and a state that the negative pressure is not generated. Therefore, the ink-jet head can maintain suitable negative pressure.

In order to solve the above problems, an ink-jet device of the present invention includes the ink-jet head device.

With the above structure, an ink-jet device can be realized in which the ink-jet head can maintain suitable negative pressure and in which consumption of ink is reduced.

In order to solve the foregoing problems, an ink-supplying method according to the present invention includes in a carriage an ink-jet head for jetting ink, a sub tank for reserving ink to be supplied to the ink-jet head, and a main tank for reserving ink to refill the sub tank, the sub tank being an elastic and bag-shaped ink reservoir, and the ink-jet head being controlled to have negative pressure to prevent ink leakage, the method comprising the step of flowing the ink in the sub tank back to the main tank by making pressure inside the sub tank relatively higher than pressure inside the main tank, the step being carried out after the sub tank is refilled with ink from the main tank and before the sub tank and the ink-jet head are communicated with each other.

After the sub tank is refilled with ink from the main tank, the sub tank, being elastic, expands due to the head difference, with the result that pressure is applied inside the sub tank. In other words, in the sub tank, the ink contained in the extra space created by the expansion will be an excess. With the above structure, however, the excess ink is ejected from the sub tank by making pressure inside the sub tank relatively higher than pressure inside the main tank. As a result, when the sub tank is in communication with the main tank, the extra pressure created by the expansion of the sub tank is not applied on the ink-jet head. Therefore, the ink-jet head can maintain suitable negative pressure.

Further, with the above structure, the excess ink ejected from the sub tank can be flown back to the main tank. This enables consumption of ink to be reduced.

As described above, in the ink-jet head device according the present invention, because the main tank and the sub tank are mounted in the carriage together with the ink-jet head, the ink-jet head can maintain suitable negative pressure and consumption of ink can be reduced.

Further, because the ink-jet device according to the present invention includes the above ink-jet head device, an ink-jet device can be realized in which the ink-jet head can maintain suitable negative pressure and in which consumption of ink is reduced.

Further, as described above, the ink-supplying method according to the present invention includes the step of flowing back ink in the sub tank to the main tank by making pressure inside the sub tank relatively higher than pressure inside the main tank, the step being carried out after the sub tank is refilled with ink from the main tank due to the head difference and before the sub tank and the ink-jet head communicates with each other. Therefore, the ink-jet head can maintain suitable negative pressure and consumption of ink can be reduced.

Further, the ink-jet head device of the present invention may be adapted to include: an ink-jet head, positioned to maintain a certain gap from a recording medium, for jetting ink to the recording medium; a small capacity sub tank, reserving a predetermined amount of ink, for supplying ink to the ink-jet head for printing; and a large capacity main tank for refilling ink to the sub tank, the ink-jet head, the sub tank, and the main tank being mounted in a carriage that horizontally scan the recording medium by maintaining a certain distance between the recording medium and the ink-jet head, the sub tank being located above the ink-jet head; the main tank being located above the sub tank, and the sub tank being connected with negative pressure generating means for generating negative pressure in the ink-jet head and with positive pressure generating means for applying pressure to the sub tank.

Further, the ink-jet head device of the present invention may be adapted so that the main tank, the sub tank, and the ink-jet head are connected to one another by a tube that diverges into three paths from a junction connected with a three-way switching valve, and the main tank and the sub tank communicates with each other at least while the power of the device is turned off.

Further, the ink-jet head device of the present invention may be adapted so that the sub tank and the ink-jet head are in communication with each other when ink is jetted, and the negative pressure generating means generates negative pressure on the ink-jet head, during which the main tank and the ink-jet head are not in communication with each other.

Further, the ink-jet head device of the present invention may be adapted so that ink is supplied from the main tank to the sub tank due to the head difference generated by locating the main tank above the sub tank.

Further, the ink-jet head device of the present invention may be adapted so that the sub tank is elastic and bag-shaped, and that when ink is refilled from the main tank, the positive pressure generating means increase pressure in the sub tank so as to flow a predetermined amount of ink back to the main tank.

Further, the ink-jet head device of the present invention may be adapted so that the negative pressure generating means include: a vacuum pump for generating negative pressure, a regulator, located between the vacuum pump and the sub tank, for adjusting negative pressure generated by the vacuum pump to a predetermined pressure; and a switching valve, located between the vacuum pump and the sub tank, for switching between a state in which negative pressure is applied to the sub tank and a state negative pressure is not applied to the sub tank.

Further, the ink-jet head device of the present invention may be adapted so that the negative pressure generating means include: a vacuum generator including an electromagnetic valve for controlling generation of negative pressure; and a regulator, located between the vacuum generator and the sub tank, for adjusting negative pressure generated by the vacuum generator to a predetermined pressure.

Further, the ink-supplying method of the present invention may be a method for an ink-jet head device that includes: an ink-jet head, positioned to maintain a certain gap from a recording medium, for jetting ink to the recording medium; a small capacity sub tank, reserving a predetermined amount of ink, for supplying ink to the ink-jet head for printing; and a large capacity main tank for refilling ink to the sub tank, the ink-jet head, the sub tank and the main tank being mounted in a carriage that horizontally scans the recording medium by maintaining a certain distance between the recording medium and the ink-jet head, the sub tank being located above the ink-jet head, the main tank being located above the sub tank, and the sub tank being connected with negative pressure generating means for generating negative pressure in the ink-jet head and with positive pressure generating means for applying pressure to the sub tank, and the ink-supplying method may be adapted to include the steps of: supplying ink from the main tank to the sub tank due to the head difference between the main tank and the sub tank; and flowing a predetermined amount of ink back to the main tank by applying pressure to the elastic and bag-shaped sub tank with the positive pressure generating means.

Note that, as used herein "ink-jet head device" means a device that includes an ink tank for reserving ink, an ink-jet head for adjusting and jetting ink, and a carriage for moving the ink-jet head, and in which the ink-jet head in the carriage performs a scan and jets ink to a medium simultaneously. The other structures are not particularly limited. Further, as used herein, the term "ink" refers to not only ink in general used for printing or drawing on a recording medium like paper, but also fluids in general.

The present invention is not limited to the above embodiments, and a variety of modifications are possible within the scope of the following claims, and embodiments obtained by combining technical means respectively described in the foregoing embodiments are also within the technical scope of the present invention.

The ink-jet head device, the ink-jet device, and the ink-supplying method of the present invention are applicable to ink-jet recording devices for performing recording on a medium like paper, and to various production devices including industrial devices for forming wires on substrates.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An ink-jet head device comprising:

an ink-jet head for jetting ink;

a sub-tank for reserving ink to be supplied to the ink-jet head;

a main tank for reserving ink to refill the sub-tank;

a movable carriage, including the ink-jet head; and a negative pressure generating unit connected to the sub-tank for generating negative pressure inside the sub-tank relative to the ink jet head;

a three-way flow path that connects the sub tank, the main tank, and the ink-jet head to one another, such that the sub tank is located above the ink-jet head and the main tank is located above the sub tank;

a flow path switching unit, disposed at a junction of the three-way flow path, for selectively switching a flow path connecting the sub tank to the main tank and a flow path connecting the sub tank to the ink-jet head, without causing the ink-jet head and the main tank to communicate with each other; and a flow path controller for controlling the flow path switching unit.

2. The ink-jet head device as set forth in claim 1, wherein the flow path switching unit includes a common port that always provides a flow path, and two non-common ports that are selectively switched to provide a flow path to the common port, wherein the common port is connected with the sub tank; and wherein one of the two non-common ports is connected with the main tank, and the other of the two is connected with the ink-jet head.

3. The ink-jet head device as set forth in claim 1, wherein the flow path switching unit switches flow paths of the sub tank according to applied voltage, and, under no applied voltage, selects a flow path connecting the sub tank to the main tank, so that the sub tank is in communication with the main tank.

4. The ink-jet head device as set forth in claim 1, wherein the sub tank is an elastic and bag-shaped ink reservoir, and the ink-jet head device further comprises:

a relative positive pressure generating unit for making pressure inside the sub tank relatively higher than pressure inside the main tank; and a relative positive pressure controller for controlling the relative positive pressure generating unit, wherein the relative positive pressure controller drives the relative positive pressure generating unit for a predetermined time period, when the flow path controller controls the flow path switching unit to refill the sub tank with ink from the main tank.

5. The ink-jet head device as set forth in claim 4, wherein the relative positive pressure generating unit makes pressure inside the sub tank relatively higher than pressure inside the main tank by applying pressure to the sub tank.

6. The ink-jet head device as set forth in claim 4, wherein the relative positive pressure generating unit makes pressure inside the sub tank relatively higher than pressure inside the main tank by reducing pressure inside the main tank.

7. The ink-jet device as set forth in claim 1, wherein the main tank, the sub tank, and the ink-jet head are mounted in the carriage, and, wherein the sub-tank has a smaller capacity than the main tank.

8. An ink-jet head device comprising:

an ink-jet head for jetting ink;

a sub-tank for reserving ink to be supplied to the ink-jet head;

a main tank for reserving ink to refill the sub-tank;

a movable carriage, including the ink-jet head; and a negative pressure generating unit connected to the sub-tank for generating negative pressure inside the sub-tank relative to the ink-jet head;

wherein the main tank, the sub-tank, and the ink-jet head are mounted in the carriage, and wherein the negative pressure generating unit includes:

a vacuum pump for generating negative pressure;

a regulator disposed between the sub-tank and the vacuum pump for controlling negative pressure generated by the vacuum pump; and a switching valve disposed between the sub tank and the vacuum pump for opening and closing a flow path.

9. An ink-jet head device comprising:

an ink-jet head for jetting ink;

a sub-tank for reserving ink to be supplied to the ink-jet head;

a main tank for reserving ink to refill the sub-tank;

a movable carriage, including the ink-jet head; and a negative pressure generating unit connected to the sub-tank for generating negative pressure inside the sub-tank relative to the ink-jet head, wherein, the main tank, the sub-tank and the ink-jet head are mounted in the carriage, and wherein the negative pressure generating unit includes:

a vacuum generator;

a regulator disposed between the sub tank and the vacuum generator for controlling negative pressure generated by the vacuum generator; and a switching valve disposed between the sub tank and the vacuum generator for opening and closing a flow path.

* * * * *